United States Patent [19]

Guerriero et al.

[11] Patent Number: 4,861,679

[45] Date of Patent: Aug. 29, 1989

[54] COMPOSITE MATERIAL OF ZN-AL ALLOY REINFORCED WITH SILICON CARBIDE POWDER

[75] Inventors: Renato Guerriero; Ilario Tangerini, both of Mestre, Italy

[73] Assignee: Nuova Samim S.p.A., Rome, Italy

[21] Appl. No.: 86,864

[22] Filed: Aug. 19, 1987

[30] Foreign Application Priority Data

Aug. 19, 1986 [IT] Italy ..... 21497 A/86

[51] Int. Cl.[4] ..... C22C 1/10

[52] U.S. Cl. ..... 428/614

[58] Field of Search ..... 428/614, 608; 164/97; 420/574

[56] References Cited

U.S. PATENT DOCUMENTS

| | | | |
|---|---|---|---|
| 3,547,180 | 12/1970 | Cochran et al. | 428/614 |
| 4,409,298 | 10/1983 | Albertson et al. | 428/614 |
| 4,469,757 | 9/1984 | Ghosh et al. | 428/614 |
| 4,473,103 | 9/1984 | Kenney et al. | 164/97 |
| 4,565,744 | 1/1986 | Walter et al. | 428/614 |
| 4,587,707 | 5/1986 | Nishida et al. | 164/97 |
| 4,662,429 | 5/1987 | Wada et al. | 164/97 |

FOREIGN PATENT DOCUMENTS

| | | | |
|---|---|---|---|
| 21306 | 2/1985 | Japan | 164/97 |
| 138043 | 7/1985 | Japan | 164/97 |
| 2149057A | 6/1985 | United Kingdom | 164/97 |
| 2172826A | 10/1986 | United Kingdom | 164/97 |
| 3997 | 7/1986 | World Int. Prop. O. | 164/97 |

*Primary Examiner*—John J. Zimmerman

*Attorney, Agent, or Firm*—Birch, Stewart, Kolasch & Birch

[57] ABSTRACT

A composite material is disclosed, which contains a matrix of Zn-Al alloy reinforced with silicon carbide powder, which powder has a granulometric distribution comprised within the range of from 1 to 200 μm.

8 Claims, No Drawings

COMPOSITE MATERIAL OF ZN-AL ALLOY REINFORCED WITH SILICON CARBIDE POWDER

The present invention relates to a composite material of a Zn-Al alloy reinforced with silicon carbide powder.

In many applications, also structural, and, specifically, in the field of transports, whether by road, by railway or by aerospace means, materials are required, which are endowed with high mechanical properties, permanent also at medium-high temperatures, accompanied by light-weight characteristics.

Among these materials, considerably interesting are the metal-matrix composites, reinforced with ceramic materials in the form of powders, whiskers, or long fibres, with possible unidimensional or planar orientations.

A proper selection of the materials constituting the matrix and the reinforcer, with their relative amounts and arrangements, can supply a wide range of products with previously "designable" characteristics.

The characteristics and the performance of a composite depend, of course, on the materials which constitute it, on their shapes and mutual arrangement, on their mutual interaction, and, finally on the methodologies used to manufacture them.

It is hence necessary to correctly evaluate all these parameters, for the purpose of ensuring the desired properties to the end product.

The mechanisms which control the efficacy of reinforcement on the matrix are several, but, among the main ones, those which cause the load to be transferred from the matrix to a reinforcer endowed with higher mechanical characteristics, or create discontinuities suitable for hindering the propagation of a fracture flaw can be regarded as fundamental.

In the first case, an increase is obtained in the ultimate tensile strength and in the elastic modulus of the composite, relative to the values of the corresponding properties of the matrix; in the second case, also an increase in toughness is obtained.

An optimum adhesion between the matrix and the reinforcer is always required, in order to attain a good transfer of the stress from the one to other.

The manufacturing techniques for composite materials are many, and are different from each other, as a function of the type of metal used as the matrix, of the reinforcement type, or of the characteristics which one wants to obtain.

The reinforcer can be constituted from powders whiskers or long fibres, whilst the metal can be in either solid or liquid phase.

In case long fibres are used, composite materials can be obtained, which have anisotropic properties, but are reinforced in the desired direction, e.g., wires, flat rolled sections, bars, or, in determined cases, also more complex shapes, with directional characteristics.

In case, on the contrary, reinforcers are used, which are constituted by powders or by whiskers, isotropic composites are generally obtained, i.e., composites endowed with homogeneous characteristics according to the various directions.

With a reinforcer constituted by powders or whiskers, composites can be obtained by admixing the solid into the liquid, or by infiltration, under pressure, of the liquid metal into pre-formed articles formed by powders or fibres, or, finally, from blends of metal powders and ceramic reinforces composites can be obtained by techniques of hot-pressing, extrusion, drawing, and, in general, of powder metallurgy.

Studies are known on composites which are obtained by blending alloys of Al, Mg, or Zn reinforced with dispersed particles of $Al_2O_3$, $SiO_2$ or SiC, with a granulometry variable from some microns to some hundreds of microns, wherein the powder-matrix interfacing is accomplished by means of metal coatings applied to the powders.

Other investigations relate to the high temperature-extrusion of blends of powders of aluminum and glass at a temperature higher than the softening point of glass (approximately 500° C.), a composite reinforced by discontinuous fibres formed in loco, due to the plastic deformation of the glass particles being obtained.

The need of having to secure an optimum bond between the fibres and the matrix is sometimes opposed by the fact that the commercial fibres have poor characteristics of wettability by the molten matrices, so that either the infiltration is made difficult, or it takes place regularly, but with the subsequent degradation of the mechanical properties.

In these cases, in order to obtain a good adhesion, it is necessary to resort to contrivances, such as particular additions to the molten material, capable of varying the wettability of the metal on the reinforcer, or particular conditions of solidification of the matrix; or, as an alternative, it is necessary to resort to fibre coatings with materials which are wettable by the metal. In any case, a perfect control of the process parameters is always necessary in order to secure the efficacy of the reinforcement.

U.S. Pat. No. 2,793,949 discloses a method for preparing composite materials containing metal and nonmetal materials, in which wetting agents are used, which are constituted by metalloids, as well as by alkali metals, or alkali-earth metals, to lower the mutual surface tensions.

The Applicant knows that composites containing from 40 to 70% by volume of fibres have been prepared by using filaments of carbon or alumina (6–20 μm). In any case, these manufacturing methods, precisely denominated "in the liquid phase" have sometimes shown a decrease in properties because of the reaction with the molten alloy, so that the practice is limited to a small number of fibre-matrix combinations.

Aluminum or magnesium alloys have been associated with carbides or oxides, preventing the agglomeration of the latter, and achieving the desired wettability, by adding, e.g., for the oxides, oxygen to the molten material. This system is claimed in U.S. Pat. No. 3,468,658.

Said patent limits the dimensions of the particles of the added materials within the range of from 100 Å to 1 μm.

The present Applicant has surprisingly found now that by reinforcing the Zn-Al alloy with a SiC powder having a granulometric distribution comprised within the range of from 1 to 200 μm, it is possible to obtain a composite material endowed with high mechanical properties, permanent at medium-high temperatures, which does not display the above mentioned drawbacks, of the other known composites.

The object of the present invention is a composite material containing a matrix of Zn-Al alloy reinforced with a silicon carbide powder, which powder has a granulometric distribution comprised within the range of from 1 to 200 μm.

Preferably, the content of said SiC powder in the composite material should not exceed 50% by volume.

The composite material can possibly contain also whiskers, such as, e.g., glass materials, metal oxides or steels.

The silicon carbide, used in powder form, is preferably of abrasive grade.

The so-obtained composite material shows a modulus of elasticity E higher than 100 GPa.

Among the processes which can be used to obtain said composites, the following may be mentioned:

blending of ceramic powders or whiskers to metals or metal alloys in the liquid or semi-solid state;

infiltration of liquid metal into pre-formed articles of ceramic powders or fibers:

sintering of metal powders blended with ceramic powders or whiskers.

Some examples are supplied now, in order to better illustrate the invention, it being understood however that in no way is said invention to be regarded as being limited by them.

EXAMPLE 1

By infiltration under pressure, a composite material was prepared from a Zn-Al alloy at 27% by weight of Al reinforced with SiC powder, the content of which is of 50% by volume, and whose granulometric distribution is comprised within the range of from 70 to 180 μm.

For the infiltration under pressure, an equipment was used, which consisted of a pyrex glass tube, wherein the metal, placed in the upper position, is forced under pressure to enter the underlying pre-formed article.

A composite material was obtained, which had zero porosity and a high abrasion resistance, with a good adhesion between the metal and the reinforcer, and which had a modulus of elasticity E=145 GPa.

EXAMPLE 2

By infiltration under pressure, a composite material was prepared from a Zn-Al alloy at 12% by weight of Al reinforced with SiC powder, the content of which is of 50% by volume, and whose granulometric distribution is comprised within the range of from 40 to 70 μm.

For the infiltration under pressure, the same equipment and the same procedure of Example 1 were used.

A composite material was obtained, which had zero porosity and a high abrasion resistance, with a good adhesion between the metal and the reinforcer, and which had a modulus of elasticity E=118 Gpa.

EXAMPLE 3

By infiltration by blending, a composite material was prepared from a Zn-Al alloy at 8% by weight of Al reinforced with SiC powder, the content of which is of 50% by volume, and whose granulometric distribution is comprised within the range of from 20 to 60 μm.

For the infiltration by blending, an equipment was used, which consisted of a temperature-controlled vessel, wherein the material was kept under strong stirring. A composite material was obtained, which had zero porosity and a high abrasion resistance, with a good adhesion between the metal and the reinforcer, and which had a modulus of elasticity E=150 GPa.

EXAMPLE 4

By infiltration by blending, a composite material was prepared from a Zn-Al alloy at 4% by weight of Al reinforced with SiC powder, the content of which is of 50% by volume, and whose granulometric distribution is comprised within the range of from 5 to 25 μm.

For the infiltration by blending, the same equipment and the same procedure of Example 3 were used.

A composite material was obtained, which had zero porosity and a high abrasion resistance, with a good adhesion between the metal and the reinforcer, and which had a modulus of elasticity E=155 GPa.

EXAMPLE 5

Example 4 was repeated, with the variant that the Zn-Al alloy contained 27% by weight of Al and SiC content was of 30% by volume, with a granulometric distribution comprised within the range of from 20 to 60 μm. The porosity was zero, the resistance to abrasion was high, the adhesion between the metal and the reinforcer was good, and the modulus of elasticity E=140 GPa.

We claim:

1. A composite material containing a matrix consisting of Zn-Al alloy reinforced with a silicon carbide powder, said powder having a granulometric distribution within the range of from about 1 to 200 μm and wherein said Zn in said Zn-Al alloy is present in an amount of from 73% to 96% by weight.

2. The composite material according to claim 1, wherein said silicon carbide powder is contained in an amount not greater than 50% by volume.

3. The composite material according to claim 1, further wherein whiskers selected from glass materials, metal oxides or steels are added.

4. The composite material according to claim 1, wherein the modulus of elasticity (E) is higher than 100 GPa.

5. The composite material according to claim 1 wherein said zinc is present in an amount of about 73% by weight zinc.

6. The composite material according to claim 1 wherein said zinc is present in an amount of about 88% by weight zinc.

7. The composite material according to claim 1 wherein said zinc is present in an amount of about 92% by weight zinc.

8. The composite material according to claim 1 wherein said zinc is present in an amount of about 96% by weight zinc.

* * * * *